US006538620B2

(12) United States Patent
Lin

(10) Patent No.: US 6,538,620 B2
(45) Date of Patent: Mar. 25, 2003

(54) SAFE STICKER ANTENNA FOR MOBILE PHONES

(76) Inventor: Susan Lin, 3F, 14, Lane 87, Tien-Mu North Road, Taipei (TW)

( * ) Notice: Subject to any disclaimer, the term of this patent is extended or adjusted under 35 U.S.C. 154(b) by 0 days.

(21) Appl. No.: 09/901,344

(22) Filed: Jul. 9, 2001

(65) Prior Publication Data

US 2003/0011530 A1 Jan. 16, 2003

(51) Int. Cl.[7] ..... H01Q 1/36; H01Q 1/24; H01Q 1/52

(52) U.S. Cl. ..... 343/895; 343/700 MS; 343/702; 343/841

(58) Field of Search ..... 343/702, 700 MS, 343/713, 718, 895, 841; 455/90

(56) References Cited

U.S. PATENT DOCUMENTS 5,752,204 A * 5/1998 Epperson et al. ..... 455/575
5,844,523 A * 12/1998 Brennan et al. ..... 343/700 MS
5,977,919 A * 11/1999 Kudo et al. ..... 343/713
6,061,028 A * 5/2000 Sakata ..... 343/702
6,281,854 B1 * 8/2001 Ohoka et al. ..... 343/767

* cited by examiner

*Primary Examiner*—Hoang Nguyen
(74) *Attorney, Agent, or Firm*—Ladas & Parry

(57) ABSTRACT

This invention utilizes the anti-radiation metal cover of the mobile phone's motherboard as a natural radiation shield and designs many spiral and square flat sticker antennae, to be placed outside or inside mobile phone's plastic cover. The radiation from the antenna can only emit unidirectionally away from the user owing to the metal cover's shielding effect. Therefore, this type of antenna design is free of radiation damage to the phone users. The sticker antenna does not need to be wired to the mobile phones. It functions purely based on the electromagnetic induction between the phone's antenna and its motherboard. A small inductive bar, plugged in the hole where the original antenna was placed, will help the induction effect.

21 Claims, 6 Drawing Sheets

SAFE STICKER ANTENNA FOR MOBILE PHONES

BACKGROUND OF THE INVENTION

1. Field of the Invention

The present invention relates to a safe antenna, and particularly to a safe sticker antenna for mobile phones.

2. Description of the Related Art

Mobile phone makers currently adopt a helical coil antenna to constitute a mobile phone. Because the antenna sticks out the housing of the mobile phone, it is not only easily broken down and inconvenient for consumers, but also unsafe for consumers due to its omni directional radiation, especially harmful to human brain.

Since the radiation of mobile phones does not draw attention by people, the mobile phone makers have not been developing a unidirectional radiation antenna. In the market nowadays, mobile phones with a hidden antenna are very few, and not to mention a sticker antenna. Besides, there is no unidirectional radiation sticker antenna to replace a common antenna. At present an antenna having an electromagnetic wave absorbing cover can achieve the effect of unidirectional radiation by covering half of the antenna, but this kind of antenna does not completely replace the conventional antenna.

In conclusion, it is desired for consumers to have a convenient unidirectional radiation sticker antenna.

SUMMARY OF THE INVENTION

The mobile phone sold in the current market adopts a helical coil antenna which extends from the mobile phone and thus is broken easily. This kind of product not only causes an inconvenience when carrying, but also damages human health due to omni directional radiations from the antenna. In use, the mobile phone is close to the user's ear, and the antenna is in the proximity of the user's brain. Strong radiation waves transmit to the user's brain. It will cause damage to the user's brain in a long time usage.

Since electromagnetic waves cannot penetrate through metal foils, the circuit board of the mobile phone is equipped with a large metal cover, and all electronic components on the circuit board are covered inside the metal cover to shield external electromagnetic interferences. When people use a mobile phone, the circuit board is at the side of the human brain, and the metal cover is at the other side. If a sticker antenna can be designed and adhered on the housing near the metal cover, the radiation waves from the antenna will propagate in a direction away from the human brain.

The present invention uses the above characteristic to design many kinds of flat sticker antennae, including spiral, square, elongated, curve and logarithm forms, which are adhered on the metal cover of the circuit board of the mobile phone or on the inside or outside of the housing near the metal cover to generate a unidirectional radiation and replace the conventional antenna.

The structure of the sticker antenna is simple, and conductive materials of the antenna in a particular pattern are printed on a soft resin film or hard resin substrate. The resin materials can be selected from normal thermal plastic resin (vinyl series) or tough plastic, such as polyester resin, polyimide resin, etc. The method for manufacturing the sticker antenna includes screen printing, evaporation, sputtering and chemical electroplating, which prints conductive materials such as metal or oxide representing patterns on the resin substrate. Besides, an etching or molding manufacturing method transfers the resin films of the conductive layer on the resin substrate. If the pattern is made from colorless and transparent materials, such as tin and indium oxide or zinc oxide, the pattern cannot be easily found on the surface of the sticker antenna. A lot of color patterns can be printed on the surface of the sticker antenna to enhance the asthetics. A typical thickness of the film is 0.075 to 0.125 mm and the thickness of the pattern will not be over 0.1 mm. Therefore, the total thickness of the antenna will not be over 0.25 mm. For example, the weight of a 40 mm×40 mm sticker antenna will not be over 0.4 g, which is almost one twelfth of the traditional helical antenna. If the housing of the mobile phone is designed in a double layer form, the sticker antenna can hide between the two layers, or directly printed on the inner side of the housing.

It is not necessary to install a conductive wire to electrically connect the sticker antenna and the circuit board, and the antenna and circuit board can interact by electromagnetic induction. If the sticker antenna is installed outside the housing, the only thing to do is to adhere the sticker antenna on the housing. A user can remove the original helical antenna, and install a small conductive rod on the antenna slot where the original antenna situated. If the sticker antenna is installed inside the housing, the only thing to do is to adhere the sticker antenna on the radiation-shielding metal cover or on the inner side of the housing. If an antenna slot on the circuit board touches the sticker antenna, the small conductive rod can be omitted. The conductive rod on the antenna slot works as a part of the antenna, and leads electromagnetic waves from the circuit board to the sticker antenna. Therefore, the conductive rod functions as an induction rod. In well receiving region, the conductive rod is not needed. The conductive rod can in a form of screw, and for reducing weight, the material of hollow aluminum can be adopted, no matter it is solid or hollow. After the induction is inserted, the hold due to the removal of the original antenna can be filled with a rubber plug to enhance beauty of sense. If the induction rod has a big head, it can fill the hole completely and no rubber plug is needed.

BRIEF DESCRIPTION OF THE DRAWINGS

The invention will be described according to the appended drawings in which:

FIG. 2(*b*) is a graph of transmission gains according to a single-arm spiral antenna of the present invention;

FIG. 3(*b*) shows an electrical field distribution according to the present invention.

PREFERRED EMBODIMENT OF THE PRESENT INVENTION

Figure 1A:
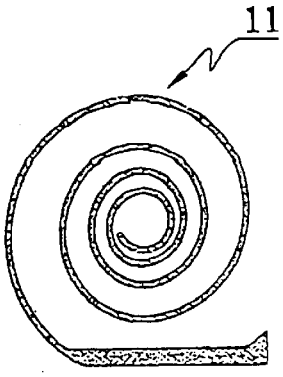
FIGS. 1(*a*)~1(*h*) show patterns of a safe sticker antenna according to embodiments of the present invention.
Figure 1B:
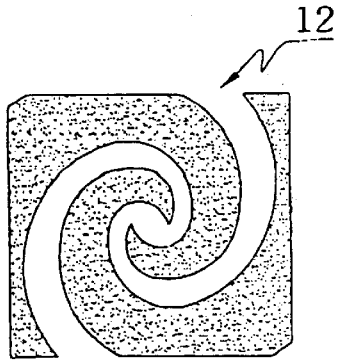
Figure 1C:
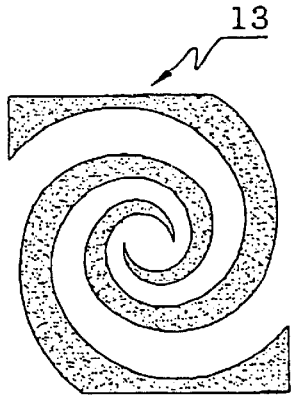
Figure 1D:
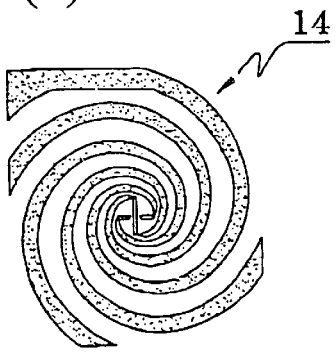
Figure 1E:
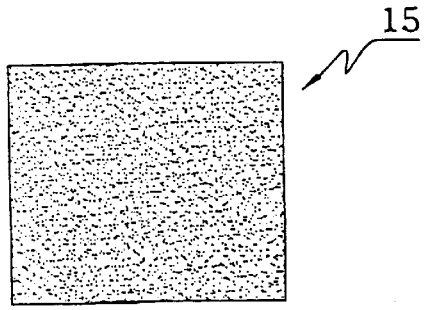
Figure 1F:
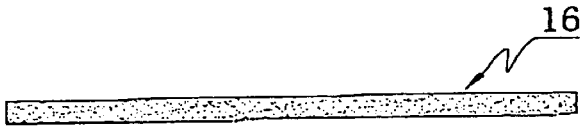
Figure 1G:
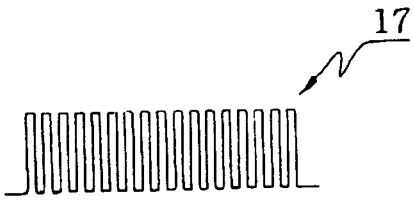
Figure 1H:
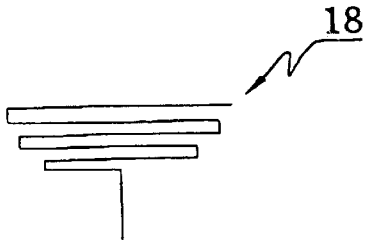

A key point to design an antenna is to match its impedance with the impedance of the circuit board of a mobile phone.

FIGS. 1(*a*)~1(*h*) show patterns of the safe sticker antenna according to embodiments of the present invention, and the patterns are single-arm spiral antenna 11, first double-arm helix antenna 12, second double-arm helix antenna 13, four-arm helix antenna 14, square antenna 15, elongated antenna 16, curve antenna 17, and logarithm antenna 18. The four arms of the four-arm helix antenna 14 are divided into two pairs with each pair of the arms connected. One pair is induced with an inductive rod, and the other pair is dangled. The length of the elongated antenna 16 is slightly less than one fourth of the wavelength, and antennae of other shapes have no such limitations. For example, in a system with a frequency 0.9 GHz or wavelength of 33.3 cm, the length of the elongated antenna 16 is about 6–8 cm. The elongated antenna 16 is suitable to the mobile phone whose space is fully occupied by batteries. In such a circumstance, the elongated antenna 16 has to be adhered to a sidewall of the housing or a conductive wire is soldered to the inductive rod to form a connection to a nearby-elongated antenna 16 since the sticker antenna and inductive rod are separated by the batteries. The feed-in of the sticker antenna is from the inductive rod 43 by induction, and the feed-in region is a strip, not a point, located beside the antenna. For example, the feed-in region of the single-arm spiral antenna 11 is at the lower end, and the feed-in region of the first double-arm helix antenna 12 is on the left. The strip of the sticker antenna must be close enough to the inductive rod 43 to react therewith through the resin housing. The performance of the antenna is evaluated according to return loss $S_{11}$, transmission gain $S_{21}$ and electrical field distribution, which are processed in a microwave dark room and measured by a network analyzer. An antenna is cascaded to a port $S_{11}$ of the network analyzer, and a standard helical antenna is cascaded to a port $S_{22}$. The port $S_{11}$ is used to estimate the return loss of the antenna, and the port $S_{12}$ is used to estimate the transmission gain of the antenna.

Figure 2A:
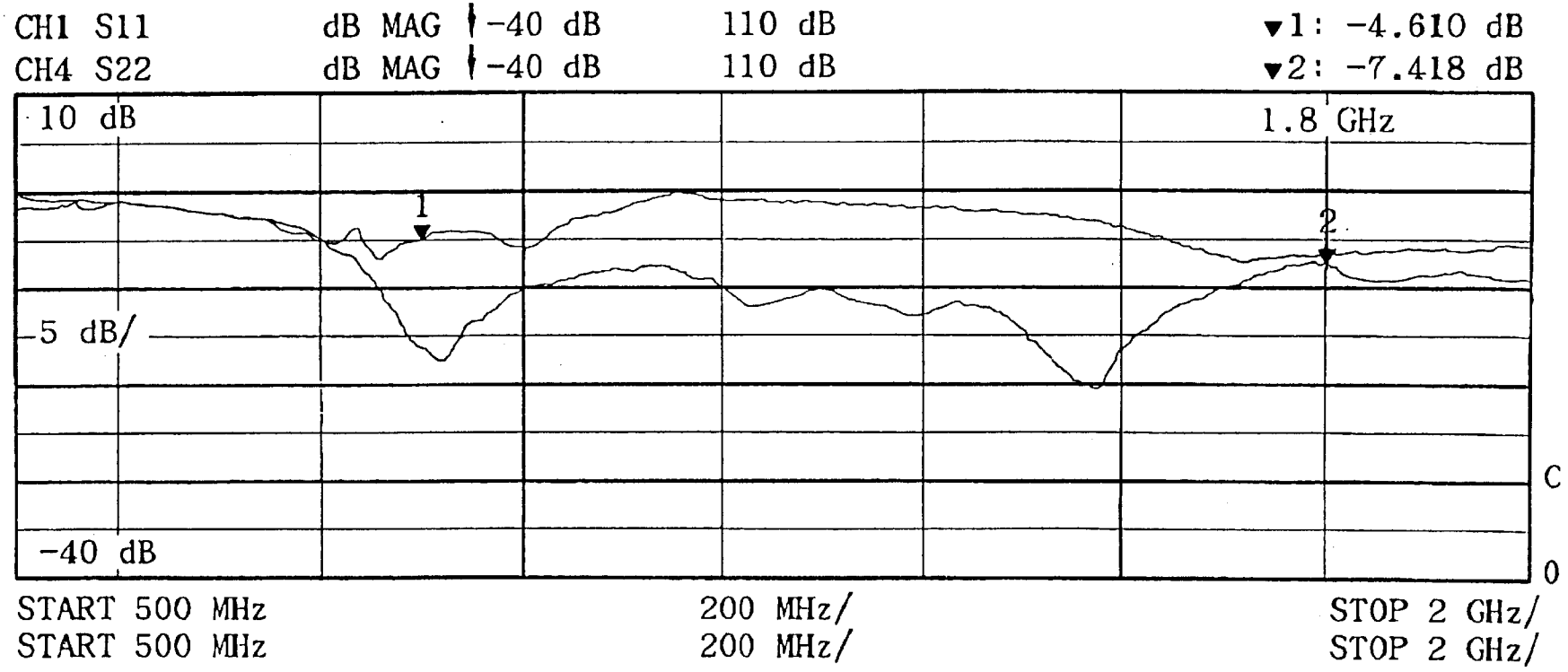
FIG. 2(*a*) is a graph of return losses according to a single-arm spiral antenna of the present invention.
Figure 2B:
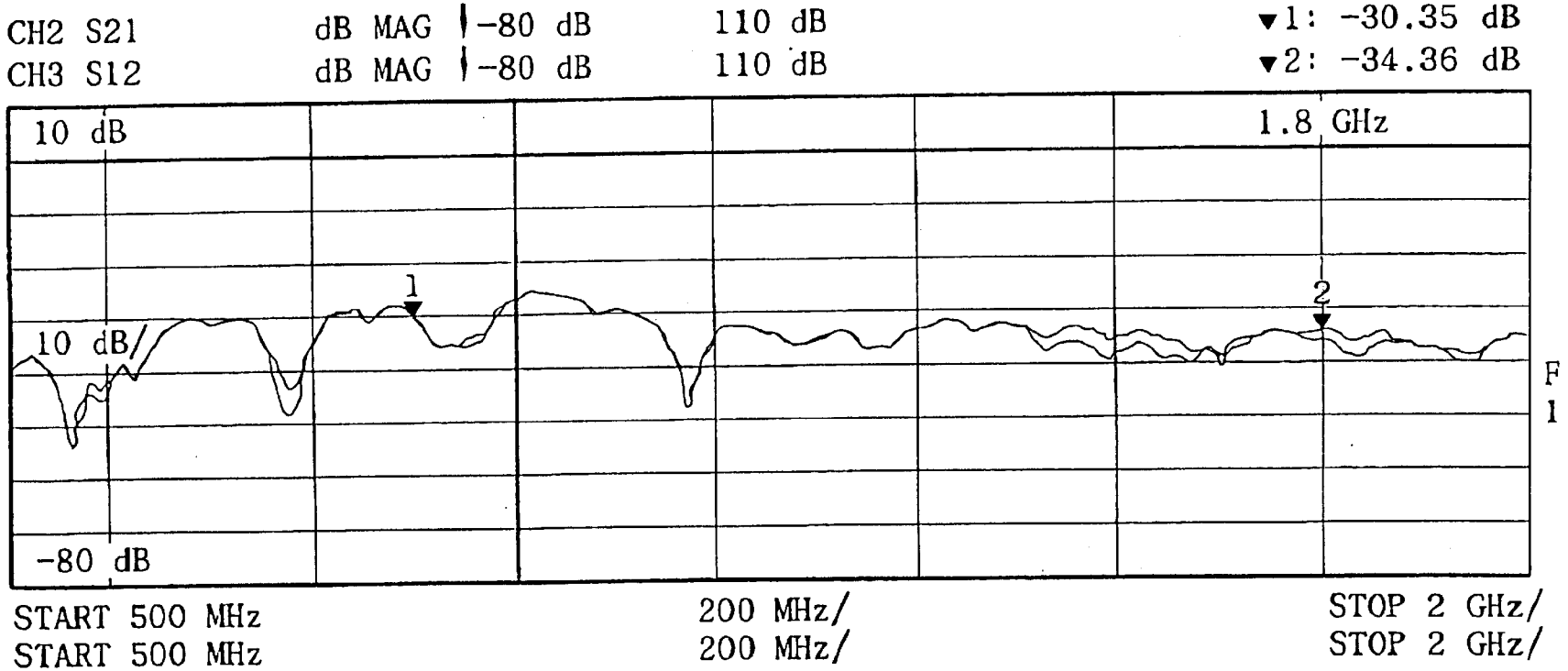

FIGS. 2(*a*) and 2(*b*) show graphs of return losses according to a single-arm spiral antenna of the present invention, and the testing frequency ranges from 500 MHz to 2 GHz. The return loss and transmission gain of other antenna types are not shown due to similarity to the waveforms in FIGS. 2(*a*) and 2(*b*), and instead are listed in Table 1. FIG. 2(*a*) represents a return loss, and FIG. 2(*b*) represents a transmission gain. There are two curves in FIG. 2, the upper one is $S_{11}$ which represents the return loss of the sticker antenna, and the lower one is $S_{22}$ which represents the return loss of the helical antenna. Table 1 shows return loss and transmission gain of different sticker antennae in the frequency range of mobile phone (900 MHz to 1.8 GHz). For comparing performance of the sticker antenna with that of the traditional helical antenna, Table 1 also lists the estimation of the traditional helical antenna.

Figure 3A:
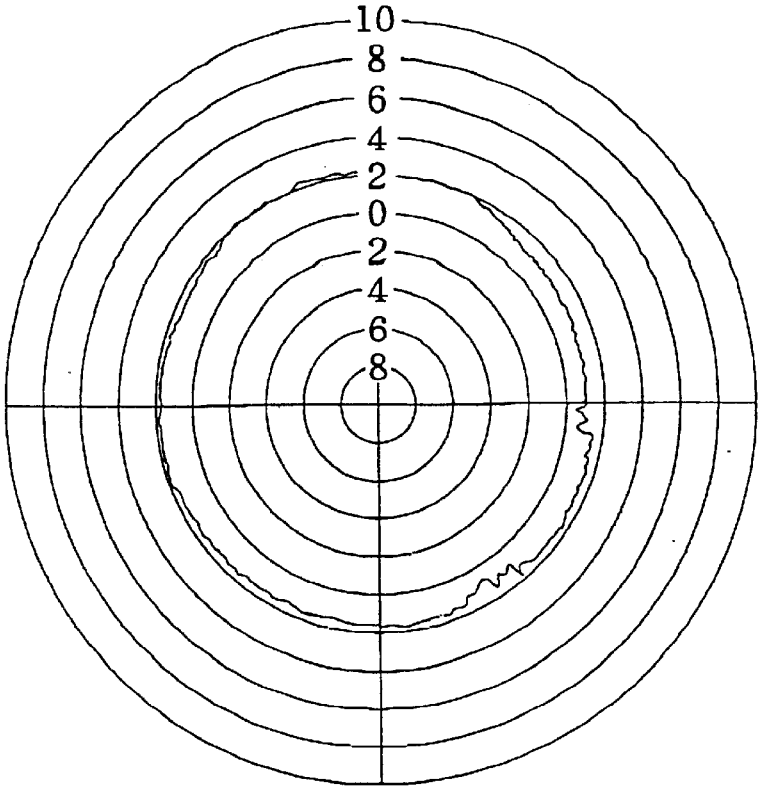
FIG. 3(a)(PRIOR ART)
FIG. 3(*a*) shows an electrical field distribution of a prior helical antenna.
Figure 3B:
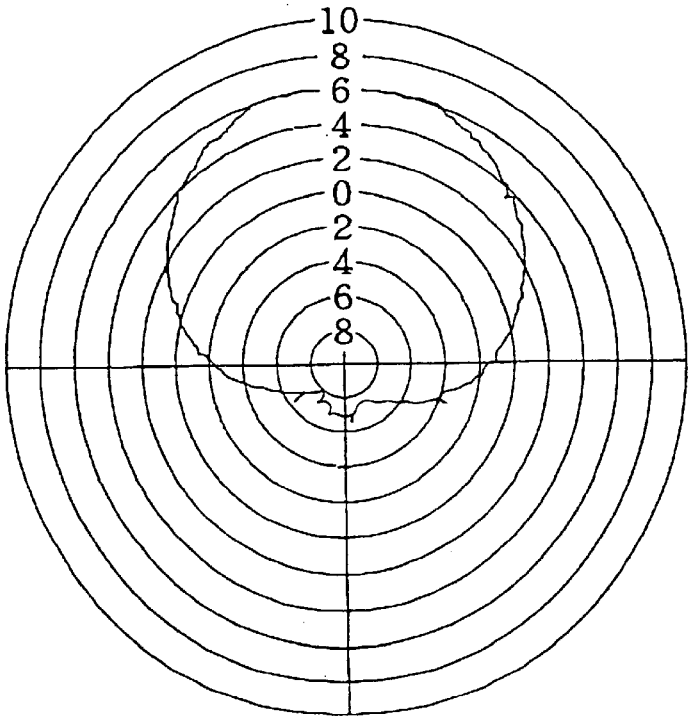

FIGS. 3(*a*) and 3(*b*) show the electrical field distribution of the prior helical antenna and sticker antenna of the present invention. It is easy to find that the electrical field distribution of the sticker antenna is semi-circular. In other words, the radiation of the sticker antenna is unidirectional and harmless to people. The shape of the electrical field distribution of the prior helical antenna is circular. In other words, the radiation of the prior helical antenna is in all directions. The more the negative value of the return loss is, the better the performance of the system is. If the value of the transmission gain is negative, the less the absolute value of the transmission gain is, the better the performance of the system is. If the value of the transmission gain is positive, the more the absolute value of the transmission gain is, the better the performance of the system is. In Table 1 and FIG. 3, it is easy to find that the radiation performance of the sticker antenna according to the present invention is similar to that of the traditional helical antenna, and a double frequency usage could also be applied in the present invention.

TABLE 1 return loss and transmission gain of different antennae (unit: db)

| | 900 MHz | | Return 1.8 GHz | |
|---|---|---|---|---|
| Frequencies Estimated kinds | loss $S_{11}$ | Transmission gain $S_{21}$ | Return loss $S_{11}$ | Transmission gain $S_{21}$ |
| Traditional helical antenna | −6.58 | −25.48 | −7.45 | −33.34 |
| Single-arm antenna | −4.61 | −30.4 | −7.41 | −34.4 |
| First double-arm antenna | −6.95 | −27.7 | −7.64 | −34.7 |
| Four-arm antenna | −7.33 | −22.75 | −7.67 | −30.0 |
| Square antenna | −7.81 | −23.88 | −7.23 | −33.32 |
| Elongated antenna | −5.41 | −28.08 | −2.56 | −29.10 |

Figure 4:
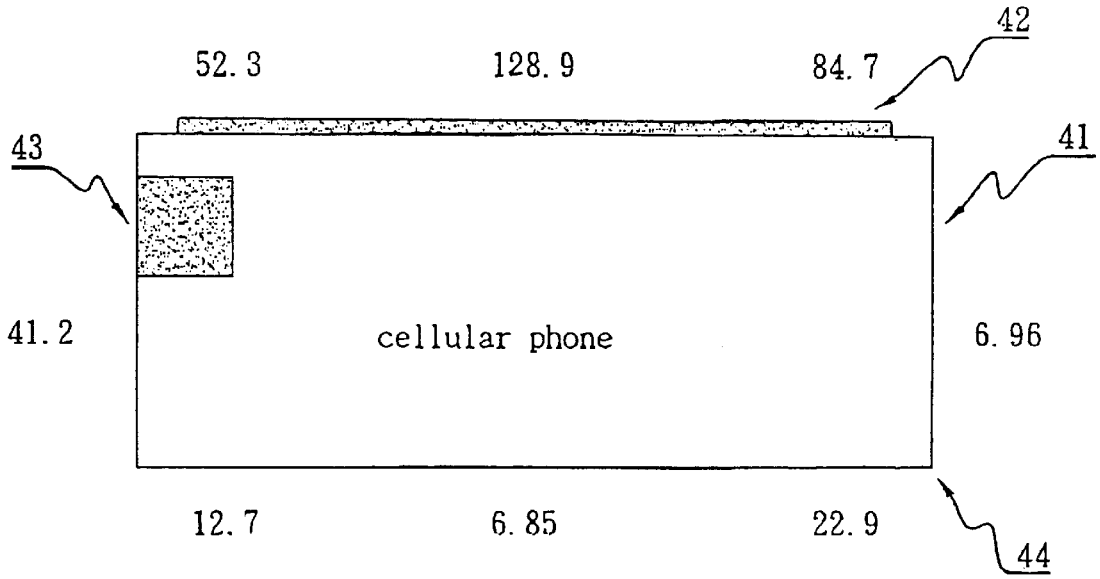
FIG. 4 shows a magnetic intensity distribution around a mobile phone using the safe sticker antenna of the present invention.

The above data are estimated by a network analyzer. The network analyzer is quite complex and expensive. In fact, the estimation of radiation intensity of a mobile phone could be utilized by a small magnetic meter, such as a known meter TES 1390. FIG. 4 shows estimation results. It is easy to find that the magnetic intensity of the place near the user of a mobile phone 41 with a sticker antenna 42 is only 6.85 mGauss, far less than 128.9 mGauss detected on the other side of the user. Therefore, the effect of unidirectional radiation of the sticker antenna 42 is obvious. FIG. 4 shows the magnetic intensity on the left side of the mobile phone is especially strong because the inductive rod is near a region where radiations are emitted. In FIG. 4, the reason why the magnetic field at the user side 44 cannot become zero is that the metal cover for preventing radiation on the circuit board has a void for dissipating heat and thus radiation could be leaked out from the void. Besides, the condition that the circuit board and antenna are now completely matched will result in a little electromagnetic waves. In FIG. 3, the signals of the network analyzer directly feed the antenna, and do not use the inductive rod 43. Therefore, the electrical field at the left side is not especially remarkable. On the contrary, the intensity of the electromagnetic waves of the same region in FIG. 4 is stronger since the inductive rod is nearby.

Figure 5:
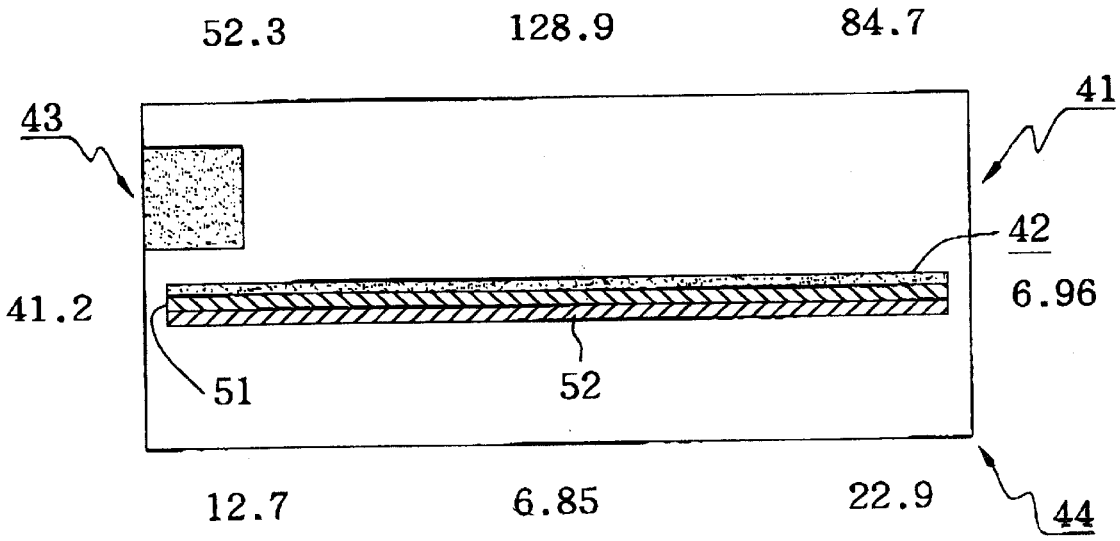
FIG. 5 is similar to FIG. 4 and shows the sticker antenna adhered on an anti-radiation shield on a circuit board in the mobile phone.

In FIG. 5, instead of being adhered on the housing as in FIG. 4, the sticker antenna 42 is shown adhered to an anti-radiation shield 51 on a circuit board 52.

There is another way to prove the unidirectional radiation characteristic of the mobile phone according to the present invention. An antenna with a LED could work as a probe for testing an electromagnetic wave. Once the probe closes to the user side of the mobile phone with a sticker antenna, the LED will not turn on. On the contrary, the LED will be turned on when the probe is moved to the other side. The situation explains that the electromagnetic waves emitted from a working mobile phone are large enough to turn on the LED of another antenna.

The quality of receiving signals and radiation of a mobile phone could be evaluated by the number of bar in a display screen. The more segments display in the bar graph is, the stronger the radiation is. The segments are five. After comparing the performance of the sticker antenna with the traditional helical antenna, it is found that the performances of both antennae are the same. In a bad receiving region, the sticker antenna has one bar of receiving quality, and the traditional helical antenna has also one bar of receiving quality. In a good receiving region, the sticker antenna has five bars of receiving quality, and the traditional helical antenna has also five bars of receiving quality.

Since the bandwidth of the sticker antenna is very wide, even wider than that of the helical antenna. Therefore, the size and pattern of the sticker antenna are not important, and if the size and pattern of the sticker antenna are appropriate, it can be used. Besides, there is no such a problem about frequency drift. For satisfying different sizes, shapes and brands of mobile phones, the sticker antenna according to the present invention can vary with different mobile phones, such as spiral, square, elongated, curve or logarithmic be. The only constrain is that the size of the sticker antenna cannot be larger than that of the metal cover. Otherwise, the effect of unidirectional radiation will be deteriorated.

The sticker antenna not only has the advantages of filtering radiation and ease in carrying, but also has the advantages of simple structure, light weight, low cost and convenience. The only thing to do is to remove the original antenna and adhere the sticker antenna of the present invention to the mobile phone, and everyone can do it.

The above-described embodiments of the present invention are intended to illustrate only. Numerous alternative embodiments may be devised by those skilled in the art without departing from the scope of the following claims.

What is claimed is:

1. A safe sticker antenna for a mobile phone, said safe sticker antenna being adhered to an anti-radiation shield on a circuit board inside a housing of said mobile phone and guiding a radiation direction of electromagnetic waves by inducing the circuit board inside the mobile phone, and wherein said safe sticker antenna is provided with a unidirectional radiation for protecting a user of said mobile phone.

2. The safe sticker antenna of claim 1, wherein said safe sticker antenna has at least one pattern, selected from spiral, square, elongated, curve and logarithmic forms.

3. The safe sticker antenna of claim 2, wherein conductive metals of said pattern are printed on a resin film or a hard resin substrate by a mesh printing, sputtering, evaporation or electroplating.

4. The safe sticker antenna of claim 3, wherein said resin film is covered with a conductive and transparent oxide.

5. The safe sticker antenna of claim 4, wherein said oxide is selected from the group consisting of tin and indium oxide, or zinc oxide.

6. The safe sticker antenna of claim 2, wherein said pattern is obtained by selectively etching a conductive layer adhered on a resin film or obtained by molding.

7. The safe sticker antenna of claim 3, wherein said resin film is a hot plastic resin or a tough plastic.

8. The safe sticker antenna of claim 7, wherein said tough plastic is selected from the group consisting of polymer resin and polyimide resin.

9. The safe sticker antenna of claim 1, wherein the surface of said safe sticker antenna is printed with color patterns.

10. A safe sticker antenna for a mobile phone, said safe sticker antenna being adhered to and guiding a radiation direction of electromagnetic waves by inducing the circuit board inside the mobile phone, and wherein said safe sticker antenna is provided with a unidirectional radiation for protecting a user of said mobile phone and an induction rod placed in a preserved antenna slot on the circuit board for increasing an induction effect.

11. The safe sticker antenna of claim 10, wherein said safe sticker antenna is adhered to an anti-radiation shield on a circuit board of said mobile phone.

12. The safe sticker antenna of claim 10, which can be adhered inside or outside of the housing of the mobile phone.

13. The safe sticker antenna of claim 10, wherein said inductive rod does not extend from the housing.

14. The safe sticker antenna of claim 10, wherein said safe sticker antenna has at least one pattern, selected from spiral, square, elongated, curve and logarithmic forms.

15. The safe sticker antenna of claim 14, wherein conductive metals of said pattern are printed on a resin film or a hard resin substrate by a mesh printing, sputtering, evaporation or electroplating.

16. The safe sticker antenna of claim 15, wherein said resin film is a hot plastic resin or a tough plastic.

17. The safe sticker antenna of claim 16, wherein said tough plastic is selected from the group consisting of polymer resin and polyimide resin.

18. The safe sticker antenna of claim 15, wherein said resin film is covered with a conductive and transparent oxide.

19. The safe sticker antenna of claim 18, wherein said oxide is selected from the group consisting of tin and indium oxide, or zinc oxide.

20. The safe sticker antenna of claim 14, wherein said pattern is obtained by selectively etching a conductive layer adhered on a resin film or obtained by molding.

21. The safe sticker antenna of claim 10, wherein the surface of said safe sticker antenna is printed with color patterns.

* * * * *